United States Patent [19]

Rutherford

[11] 4,430,915

[45] Feb. 14, 1984

[54] LUMBER SORTER AND METHOD

[75] Inventor: Jeffrey D. Rutherford, Veneta, Oreg.

[73] Assignee: Swan-Ford Enterprises, Noti, Oreg.

[21] Appl. No.: 282,918

[22] Filed: Jul. 13, 1981

[51] Int. Cl.[3] ..... B27B 5/04

[52] U.S. Cl. ..... 83/104; 83/107; 83/425.4

[58] Field of Search ..... 83/102–107, 83/165, 425.2, 425.3, 425.4; 144/376, 378

[56] References Cited

U.S. PATENT DOCUMENTS

| | | | |
|---|---|---|---|
| 1,614,362 | 1/1927 | Hardy | 83/425.3 |
| 1,724,042 | 8/1919 | Price . | |
| 2,468,036 | 4/1949 | Charters . | |
| 2,640,446 | 6/1953 | Morrison | 83/102 |
| 2,706,001 | 4/1955 | Wilder | 83/105 |
| 3,017,909 | 1/1962 | Bowling et al. . | |
| 3,101,755 | 8/1963 | Stupfel | 83/102 |
| 3,139,125 | 6/1964 | Pearson . | |
| 3,148,715 | 9/1964 | Alter | 83/104 |
| 3,225,800 | 12/1965 | Pease . | |
| 3,687,269 | 8/1972 | Fritz et al. . | |
| 3,732,765 | 5/1973 | Fritz et al. . | |
| 3,795,164 | 3/1974 | Schneider | 83/425.4 X |
| 3,832,922 | 9/1974 | Stout | 83/372 |
| 4,116,098 | 9/1978 | Suzuki | 83/425.4 |

*Primary Examiner*—James M. Meister

*Attorney, Agent, or Firm*—Klarquist, Sparkman, Campbell, Leigh & Whinston

[57] ABSTRACT

A lumber sorter is provided for sorting aligned, side-by-side pieces of lumber. The sorter includes: (1) apparatus for driving fewer than all of the pieces along a first path of travel, while driving the remaining pieces along a second path of travel, the second path being vertically divergent with respect to the first path; and (2) laterally extending support apparatus for receiving and supporting the pieces which are driven along the first path of travel. The invention may alternatively be defined as a lumber edging picker conveyor adapted to receive boards and adjacent edgings from a lumber edger having a plurality of edger saws. The lumber edging picker conveyor includes: (1) apparatus for driving the boards along a first path of travel, while driving the edgings along a second path of travel, the second path being vertically divergent with respect to the first path; and (2) laterally extending support apparatus for receiving the boards from the driving apparatus and for supporting the boards in the first path of travel.

19 Claims, 5 Drawing Figures

LUMBER SORTER AND METHOD

BACKGROUND OF THE INVENTION

1. Field of the Invention

This invention relates generally to lumber handling and sorting equipment, and more particularly to lumber edging picker conveyors.

2. Description of the Prior Art

In a lumber mill, rough boards which are cut from a log are sent through an "edger," where bark and board edges of uneven outline are removed to leave a board of substantially rectangular cross section. The edger typically has two or more spaced apart, side-by-side circular saws, through which a wide, untrimmed board or lumber slab is conveyed lengthwise. In addition to trimming off rough outside edges, the edger often performs longitudinal cuts on the boards, thereby dividing each board into two or more narrower boards.

During this trimming or "edging" operation, the narrow, rough strips or "edgings" are removed from the lumber and must somehow be isolated from the boards downstream of the edger saws. Optimum efficiency usually results if, on leaving the edger, the edgings are immediately separated out from the flow of boards, enabling the boards to be further processed without encumbrance by the edgings. Once the edgings are separated out, they are chipped, burned, or otherwise treated. The equipment for performing this separating function is typically referred to as an edging picker outfeed conveyor.

Conventional outfeed conveyors are disclosed in U.S. Pat. Nos. 3,139,125 and 3,017,909 and are marketed by Schurman Machine Works, Inc., and Portland Iron Works. The principle of operation of the conveyors disclosed in these patents and of the Schurman and Portland conveyors is basically the same. The outfeed conveyor has a first fixed "fence" which is aligned with a first fixed edger saw, which cuts off one rough edging. The outfeed conveyor also has a movable fence, which is aligned with and moves with a second laterally movable saw or a third saw if the lumber slab is to be cut into two narrower boards. In any event, the movable fence is typically aligned with the saw that cuts off the second rough edge. As the lumber moves through the edger saws, the waste edging from the first saw is diverted by the first fixed fence to one side of the outfeed conveyor. The edging cut by the second or third saw is diverted by the movable fence to the other side of the outfeed conveyor. The finished lumber, cut to width, moves over the outfeed conveyor between the fences.

Variations of these basic prior art edging picker outfeed conveyors are disclosed in the following U.S. patents: U.S. Pat. No. 1,724,042 uses a fixed shear strip with a wedge-shaped downstream end portion to divert edgings laterally from the edged lumber (see FIG. 8); U.S. Pat. No. 2,468,036 uses rollers with one set of enlarged ends aligned with the saw blade to cause a slab cut from a log to lie flat as it is diverted sideways after being separated from the log; U.S. Pat. No. 3,687,269 uses a conventional edging picker along with sweep plates or fingers; and U.S. Pat. No. 3,732,765 uses sweep fingers to separate and divert cut lumber in desired directions on an outfeed conveyor.

A second type of conventional edging picker outfeed conveyor is disclosed in the U.S. Pat. No. 3,225,800. The apparatus disclosed in this patent uses a pair of outfeed conveyor belts downstream of the edger, with both belts being laterally displaceable so that one belt is always aligned between the fixed and one movable saw, while the other belt is always aligned between the one movable saw and a second movable saw. The belts are driven and appear to be the principal outfeed conveyor means for the edged lumber. Although it is unclear from the patient, it appears that the edgings drop to opposite sides of the two belts.

All of the above-described systems are relatively complex in design and therefore involve a substantial capital investment to purchase. Because of this complexity, they can also be difficult and therefore expensive to maintain. In normal operation, wearing of the components can result in inaccuracy which can dramatically affect the performance of the system because precise adjustment of the various components is often essential to ensure proper operation. Another problem with many prior art designs, which is particularly noticeable with respect to the system disclosed in U.S. Pat. No. 3,225,800, is that the operator must wait until lumber is downstream of the edging picker conveyor before resetting the position of the edger saws. If this is not done, there is a good chance of losing lumber off of the belts as they shift in a lateral direction. Since the saws must often be reset after each board has passed through, the necessity of having to wait for the prior board to clear the conveyor dramatically reduces the output of the edger.

Hence, it is a primary object of the present invention to provide an improved lumber sorter which effectively and reliably overcomes the aforementioned limitations and drawbacks of the prior art proposals. More specifically, the present invention has as its objects one or more of the following, taken individually or in combination:

(1) The provision of an edging picker conveyor which can operate at higher speeds by permitting transverse adjustment of the edger saws while the board which has just passed through the saws is still on the edging picker conveyor;

(2) To develop an edging picker conveyor in which the settings and adjustments need not be as precise as with the prior art proposals, thereby simplifying operation and eliminating the requirement of costly and complicated control mechanisms;

(3) To provide a lumber sorter which is simple in construction and therefore is relatively inexpensive to purchase and is reliable, requiring a minimum of maintenance; and (4) The development of an edging picker conveyor which is narrower than prior art designs and is adapted to eject edgings downwardly rather than laterally, thereby facilitating the use of a greater number of picker conveyors in any given space.

SUMMARY OF THE INVENTION

This invention responds to the problems presented in the prior art by providing a lumber sorter which is adapted to sort laterally aligned pieces of lumber. Thus, while the invention is normally used as an edging picker conveyor to separate edged boards from adjacent edgings, the invention is applicable to resaw operations or the like where a plurality of boards have been cut from a single slab of lumber, the boards being aligned and being directed endwise into the sorter. So defined, the sorter includes: (1) means for driving fewer than all of the pieces along a first path of travel, while driving the remaining pieces along a second path of travel, the second path being vertically divergent with respect to the first path; and (2) laterally extending support means for receiving and supporting the pieces which are driven along the first path of travel.

Another way to define the invention is as a lumber edging picker conveyor which is adapted to receive boards and the adjacent edgings from a lumber edger. The picker conveyor includes means for driving the boards along a first path of travel, while driving the edgings along a second path of travel, the second being vertically divergent with respect to the first path. The picker conveyor also includes support means for receiving the boards from the driving means and for supporting the boards in the first path of travel.

The driving means mentioned in the immediately preceding paragraph normally include roller drive means for driving the boards and their edgings in a substantially horizontal direction and upwardly inclined ramp means for receiving the boards from the roller drive means and for conveying the boards along the first path of travel toward the support means. When the driving means are so constructed, the conveyor normally also includes aperture means through which the edgings pass, thereby permitting the edgings to drop, by gravity, with respect to the boards. The phrase "aperture means" as used herein is intended to define a region where there is a lack of supporting structure for the edgings. Thus, the boards may be passed along for subsequent finishing while the edgings may be dropped into a storage bin, onto an edging conveyor, or be immediately passed through a chipper. In any event, the rapid, complete segregation of the edgings from the boards facilitates optimum performance of subsequent operations on both the boards and the edgings.

The invention may alternatively be defined as a lumber edging picker conveyor which includes the following components: (1) lumber drive means for receiving boards and the adjacent edgings from a lumber edger and for driving the boards and edgings along a predetermined path; and (2) inclined ramp means for conveying only the boards along an upwardly inclined path while the boards and the edgings are being driven by the lumber drive means, so that the boards will be displayed vertically with respect to the edgings. When so defined, the invention also normally includes outfeed means for receiving the boards from the inclined ramp means and the edgings from the lumber drive means, the outfeed means including means for supporting the boards and aperture means for receiving the edgings, the aperture means being disposed below the supporting means so that the supporting means assist in the progressive vertical displacement of the boards with respect to the edgings.

The inclined ramp means mentioned above normally comprise a plurality of rollers aligned along the path of travel of the boards, with at least some of the rollers being transversely adjustable to accommodate boards of varying widths.

Another way to define the invention is as a method for segregating boards with respect to their adjacent edgings, while are both being fed from a lumber edger. The method includes the following steps: (1) driving the boards along a first path of travel; (2) simultaneously driving the edgings along a scond path of travel, the second path of travel being vertically divergent with respect to the first path of travel; (3) supporting, with laterally extending support means, the boards which have been driven along the first path of travel. As noted above, the step of driving the boards typically involves driving the boards along an upwardly inclined path of travel.

Yet another way to define the invention is as an edging picker conveyor for separating edgings from edged boards, which includes the following: (1) first conveyor means downstream of the saws for receiving and conveying the edgings and the edged boards endwise; (2) second conveyor means downstream of and in line with the first conveyor means but spaced therefrom to define a gap therebetween, the second conveyor means being disposed at a differential level than the first conveyor means; the first conveyor means being driven and operable to convey the edged boards and edgings endwise downstream into and beyond the gap; and (3) ramp means bridging the gap so that the first conveyor means can convey edged boards endwise over the ramp means and onto the second conveyor means, the ramp means including separate ramp elements defining the lateral limits of the ramp means, at least one of the separate ramp elements being selectively movable transversely to determine which of the cut edgings and boards will be conveyed by the first conveyor means onto the ramp means.

BRIEF DESCRIPTION OF THE DRAWINGS

The invention will be better understood and objects other than those set forth above will become apparent when consideration is given the following detailed description thereof. Such description makes reference to the annexed drawings wherein.

DETAILED DESCRIPTION OF THE PREFERRED EMBODIMENTS

Figure 1:
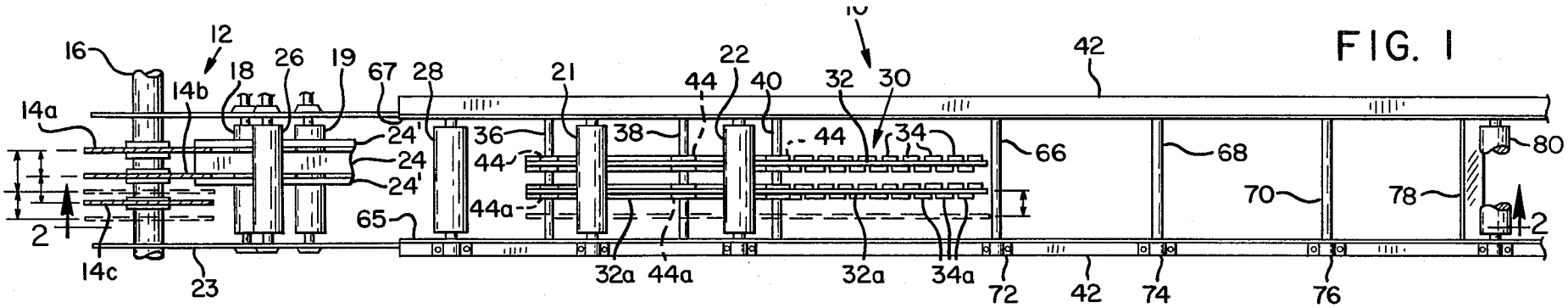
FIG. 1 is a plan view of one embodiment of the present invention depicting the edger saws and lifter arms in both an initial and an adjusted position (the latter being in phantom)
Figure 2:
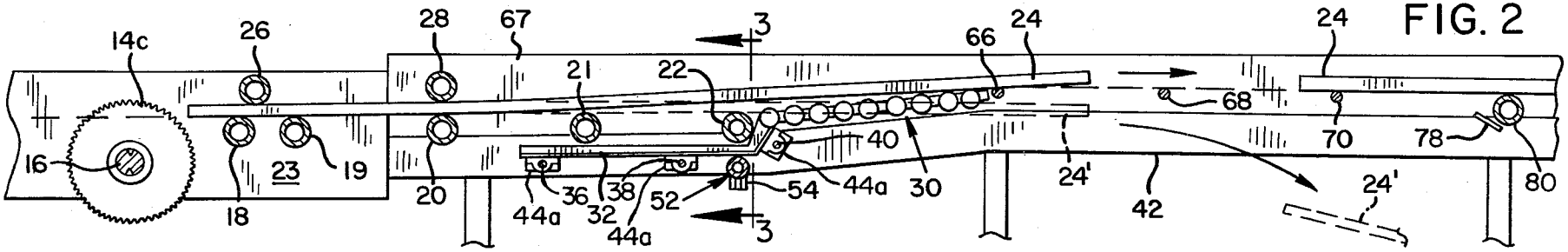
FIG. 2 is a side elevation sectional view taken along line 2—2 of FIG. 1 depicting a board and its edgings being driven through the edging picker conveyor of FIG. 1.

The principles of this invention are particularly useful when embodied in a lumber edging picker conveyor, such as that illustrated in FIGS. 1–5, generally indicated by the numeral 10. As shown in FIGS. 1 and 2, edging picker conveyor 10 is adapted to be positioned immediately downstream of a lumber edger 12. Edger 12 includes a plurality of axially aligned, circular saws 14*a*, 14*b*, and 14*c* which are mounted to a drive shaft 16. The drive shaft 16 is driven at a high rate of speed by conventional means (not shown). It should be appreciated that edging picker conveyor 10 may be modified as described below, to be used with edgers having as few as two or as many as four or more edger saws.

As indicated in phantom in FIG. 1, edger saws 14*b* and 14*c* are designed to be transversely adjustable. The means for providing such adjustability are of conventional design and therefore have not been depicted nor will be described herein. The adjustability is provided in order to adapt the system to cut boards of different widths. For example, the position of the edger saws 14*a* and 14*b* depicted in solid lines might define a spacing of four inches so that a two-by-four would be cut. In fact, with the three edger saws 14*a*, 14*b*, and 14*c* in the positions depicted in solid lines, edger 12 would be adapted to saw two two-by-fours from a single slab of lumber. With edger saws 14*b* and 14*c* shifted to the positions depicted in phantom, edger 12 would be adapted to saw a single two-by-six, or a two-by-six and a two-by-four, out of a single lumber slab. Again this edger capability is well known in the art, so will not be described further.

First and second drive rolls 18 and 19 are disposed immediately downstream of edger 12, to receive boards 24 and their adjacent edgings 24', and to drive the boards and edgings into the edging picker conveyor 10. Drive rolls 18 and 19 are rotatably mounted to a conveyor frame 23 and are typically driven off a motor (not shown) of conventional design, at an equal rate of speed. A first hold-down roll 26 is positioned above and between first and second drive rolls 18 and 19 and is permitted to rest upon but rotate freely with respect to the boards 24 and their edgings 24'. This ensures effective driving of the boards and edgings, bur since first hold-down roll 26 is merely resting upon the lumber and is not vertically fixed in conveyor frame 23, it can accommodate boards of differing thicknesses.

A third drive roll 20 and a second hold-down roll 28 are provided immediately downstream of first and second drive rolls 18 and 19 and first hold-down roll 26. Third drive roll 20 and second hold-down roll 28 continue the driving of boards 24 and their adjacent edgings 24' and prevent any deflection or misdirection thereof. Third drive roll 20 and second hold-down roll 28 are similarly rotatably mounted to conveyor frame 23, with the third drive roll being driven by the same motor that drives first and second drive rolls 18 and 19. Like first hold-down roll 26, second hold-down roll 28 merely rests upon the board and edgings and is not vertically fixed with respect to conveyor frame 23, thereby accommodating lumber of differing thicknesses.

Figure 3:
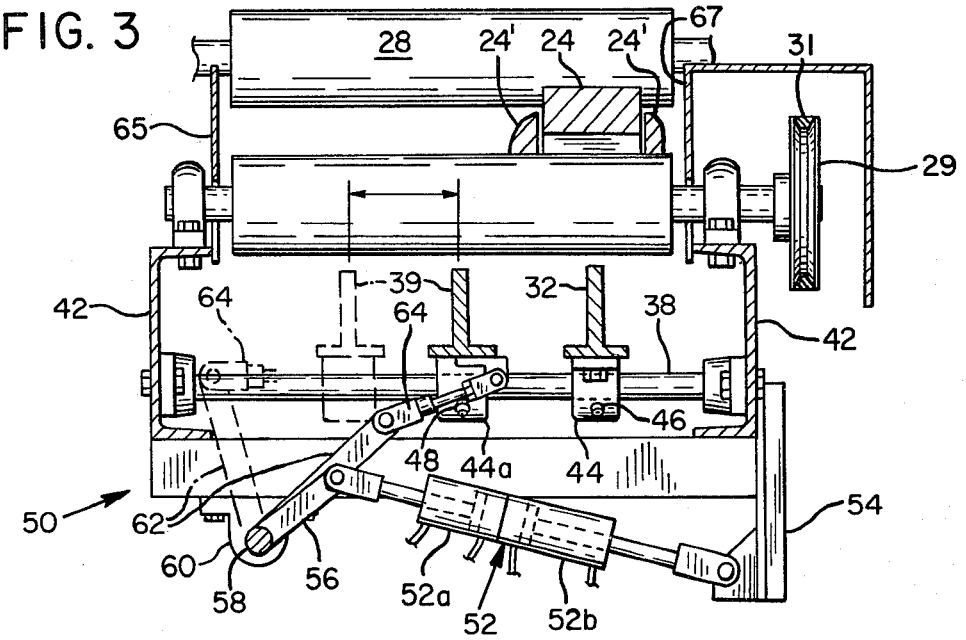
FIG. 3 is an end elevation sectional view taken along line 3—3 of FIG. 2, also depicting the lifter arms in an initial and an adjusted position (the latter being in phantom)

Fourth and fifth drive rolls 21 and 22 continue to drive the boards 24 and adjacent edgings 24' and are knurled to increase friction and minimize the possibility of lateral deflection of the boards and edgings. Fourth and fifth drive rolls 21 and 22 are also rotatably mounted in conveyor frame 23 and are driven by the motor (not shown) which drives first, second, and third drive rolls 18, 19, and 20. FIG. 3 depicts a fifth drive roll drive wheel 29 which is mounted to drive fifth drive roll 22 via a drive belt 31. While corresponding drive wheels have not been shown for first through fourth drive rolls 18–21 in order to simplify the drawings, such drive wheels are normally provided.

As shown best in FIG. 2, upwardly inclined ramp means 30 are provided for guiding the boards 24, but not their edgings 24', along an upwardly inclined path of travel. In the depicted embodiment ramp means 30 comprise a pair of side-by-side lifter arms 32 and 32*a*, to which are mounted a plurality of freely rotatable rollers 34 and 34*a*. In some applications, the rollers 34 and 34*a* may be deleted, but in order to reduce friction between lifter arms 32 and 32*a* and the boards 24, the rollers are normally included.

Lifter arms 32 and 32*a* are mounted to first, second, and third lifter arm support members 36, 38, and 40 which extend between the two sides of a conveyor roll case 42.

Bushings 44 and 44*a* are typically included to mount lifter arms 32 and 32*a* to lifter arm support members 36, 38, and 40. Lifter arm 32*a* is tranversely displaceable, while lifter arm 32 is fixed with respect to lifter arm support members 36, 38, and 40. To accommodate for this difference in function, bushings 44 are provided with set screws 46, which fix lifter arm 32 with respect to lifter arm support members 36, 38, and 40. Bushings 44*a*, on the other hand, are provided with grease fittings 48 to ensure that lifter arm 32*a* will be freely movable along lifter arm support members 36, 38, and 40.

The function of lifter arms 32 and 32*a* is to receive the boards 24 from edger 12 and to guide the boards, but not their adjacent edgings, along an upwardly inclined path of travel. Thus, the edgings 24' follow a second, initially horizontal, path of travel which becomes downwardly disposed as the effects of gravity take hold on the edgings. Since it is essential that lifter arms 32 and 32*a* support only the boards 24 and not their edgings 24', the transversely adjustable lifter arm 32*a* must be disposed in a position which is directly related to the position of adjustable edger saws 14*b* and 14*c*. Lifter arm 32 is transversely fixed, as is edger saw 14*a*; so these components will always be disposed properly. However, with edger saws 14*b* and 14*c* in the position depicted in solid lines in FIG. 1, lifter arm 32*a* must be disposed somewhere in the vicinity of the position depicted in solid lines in FIG. 1. With edger saws 14*b* and 14*c* adjusted to the position depicted in phantom in FIG. 1, ramp lifter arm 32*a* must also be shifted to something approximating the phantomed position. This will ensure that lifter arm 32*a* will be substantially centered between edger saws 14*b* and 14*c* and will properly receive the board 24 cut by those saws.

The cooperation of edger saws 14*b* and 14*c* and lifter arm 32*a* will be described in more detail in the Operation sections and this description, but the structure of the components providing this cooperation will now be described.

Figure 4:
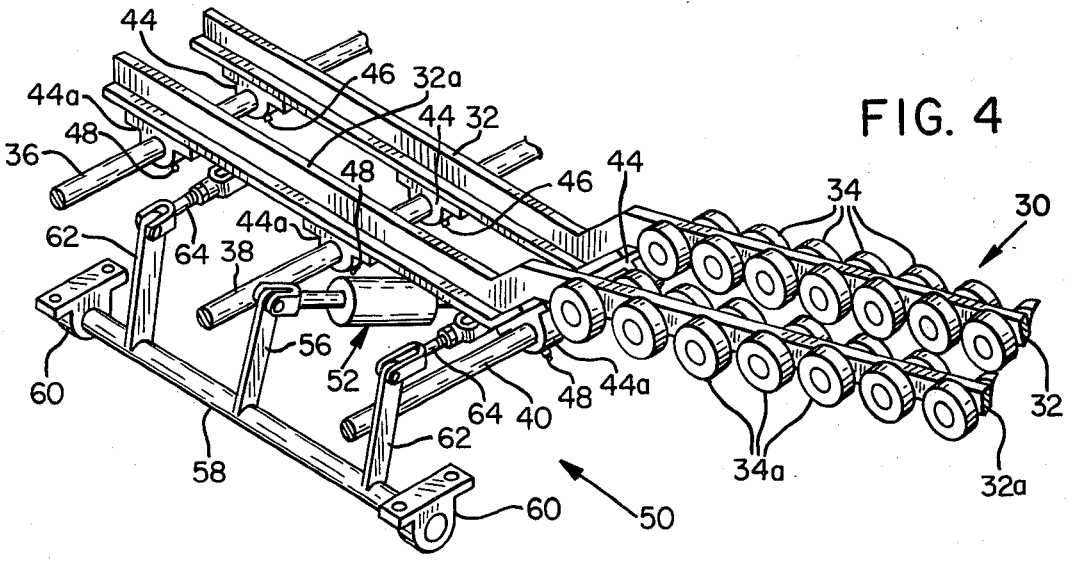
FIG. 4 is a fragmentary perspective view of the embodiment of FIGS. 1–3 depicting the means for transversely adjusting the position of the lifter arms.

Electrical circuitry (not shown) actuates a lifter arm shifting mechanism 30, depicted in FIGS. 3 and 4, so that any transverse displacement of edger saws 14*b* or 14*c* will result in a corresponding transverse shifting of lifter arm 32*a*. For reasons which will be evident in the Operation sections of this description, a time delay is provided between the shifting of edger saws 14*b* and 14*c* and that of lifter arm 32*a*. Once the time delay has occurred and the circuitry demands a transverse shifting of lifter arm 32*a*, switches (not shown) are activated to second control air to either a two-inch section 52*a* or a three-inch section 52*b* of a pneumatic control cylinder 52, which will cause the control cylinder to either extend or contract two or three inches. Pneumatic control cylinder 52 is pivotally connected on one end to a control cylinder support arm 54 which extends downwardly from conveyor roll case 42, and on the other end to a control cylinder extension arm 56. The control cylinder extension arm 56 is rigidly mounted to a control cylinder shaft 58 which is rotatably mounted to conveyor roll case 42 by bushings 60. Control cylinder shaft 58 is interconnected with transversely adjustable lifter arm 32*a* by a pair of lifter arm extension members 62 and lifter arm extension links 64, which are pivotally mounted to one another so that any rotational displacement of control cylinder shaft 58 will be conveyed through these members to transversely shift lifter arm 32*a* across lifter arm support members 36, 38, and 40.

Upwardly extending fences 65 and 67 are provided along each lateral edge of edging picker outfeed conveyor 10 to prevent the boards 24 from sliding off of the conveyor during the picking process. The fence 67 which is adjacent the drive means for drive rolls 18–22 actually takes the form of a protective cover for the drive means, thereby serving two separate functions.

First, second, and third outfeed shaft rolls 66, 68, and 70 are provided immediately downstream of ramp means 30 to receive the boards 24, but not the edgings 24', and convey the boards along a substantially horizontal path. Outfeed shaft rolls 66, 68, and 70 are rotatably mounted to conveyor roll case 42 and are driven at a rate of speed which corresponds to that of drive rolls 18, 19, 20, 21, and 22, but by a separate outfeed shaft motor (not shown). Each of the outfeed shafts 66, 68, and 70 includes bearings on each end, one of which is shown for each shaft at 72, 74, and 76, which is driven by a common chain (not shown) from an outfeed shaft motor (not shown). In the preferred design at least first outfeed shaft 66 is knurled, although this is not a necessary feature. As shown best in FIG. 2, the edgings 24', which are not supported by outfeed shaft rolls 66, 68, and 70, are permitted to drop downwardly into a bin or a suitable conveyor (not shown). In order to facilitate the handling of extremely stiff edgings which have not yet dropped down into the bin or conveyor by the time the boards and edgings reach the end of edging picker conveyor 10, an edging shear 78 is provided to wedge remaining edgings 24' downwardly away from the boards 24.

Additional outfeed rolls are typically provided downstream of outfeed shaft rolls 66, 68, and 70 in order to continue the conveyance of boards 24 to the next work station. Only one such additional outfeed roll 80 is depicted in the figures.

Principle of Operation

The principle on which the present invention operates is to drive the boards 24 along a path of travel which is upwardly inclined with respect to the path of travel in which the edgings 24' are driven. In the depicted embodiment this feature is provided through the use of lifter arms 32 and 32*a* and rollers 34 and 34*a*. The edgings 24', which are immediately adjacent the boards 24 as the boards and edgings leave edger 12, are not supported by lifter arms 32 and 32*a* and are therefore permitted to progressively drop, by gravity, with respect to the boards 24.

Figure 5:
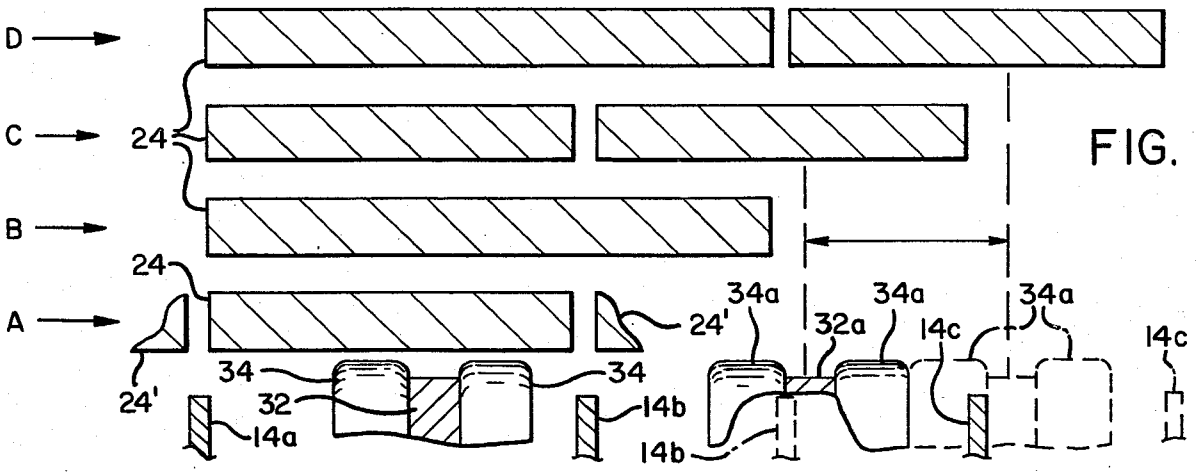
FIG. 5 is an enlarged schematic view showing the adaptability of the lifter arms to receive boards of various widths.

FIG. 5 schematically depicts the method by which rollers 34 and 34*a* support the boards 24 without supporting edgings 24'. This figure, which depicts the boards, edger saws, and rollers from an endwise direction, is greatly enlarged compared to the other figures. At position A in FIG. 5, edger saws 14*a* and 14*b* are disposed to cut a single two-by-four from a slab of lumber. Lifter arm 32, which is transversely fixed, supports rollers 34 in position between edger saws 14*a* and 14*b*. Thus, the resulting two-by-four board 24 which is cut by edger saws 14*a* and 14*b* is supported by rollers 34, while the edgings 24' are not. In the depicted embodiment, rollers 24 are slightly offset with respect to the transverse centerline of two-by-four board 24. However, this does not, in actual operation, affect the performance of edging picker conveyor 10; that is, the configuration of rollers 34 and 34*a* is such that adequate support is provided for the boards 24. This capability of edging picker outfeed conveyor 10 to operate satisfactorily as long as the rollers are disposed in a generally central position under the boards is a real advantage over some of the prior art designs which require precise positioning of the components.

During the cutting of a single two-by-four, the position of lifter arm 32*a* and its rollers 34*a* is unimportant as long as rollers 34*a* are sufficiently displaced with respect to rollers 34 so that the adjacent edging 24' will not contact rollers 34*a*. Thus, it will usually be sufficient to transversely shift rollers 34*a* two inches rightwardly to the position depicted in phantom in FIG. 5. However, it is preferable to shift rollers 34*a* an additional three inches to the right of the phantomed position, or a total of five inches from the position depicted in solid lines, in order to ensure that rollers 34*a* do not obstruct the fall of the adjacent edging 24'.

Position B in FIG. 5 depicts the cutting of a two-by-six board 24 (although the edgings 24' have not been depicted for simplification purposes). Edger saw 14*b* is first shifted transversely to the position depicted in phantom. As the lumber slab is passing through edger 12 and is being cut by edger saws 14*a* and 14*b*, but before board 24 reaches rollers 34 and 34*a*, lifter arm 32*a* and its rollers 34*a* are transversely shifted to the position referred to above (but not depicted), five inches to the right of the position depicted in solid line. With rollers 34*a* thus positioned, lifter arm 32 and rollers 34 provide support for the edged two-by-six board 24 but do not obstruct the fall of the edgings 24'. Again, it may be sufficient to shift rollers 34*a* only two inches rightwardly to the position depicted in phantom, but, for the reason described above, that is not the preferred procedure.

Position C of FIG. 5 depicts the cutting of two two-by-four boards 24 from a single lumber slab. Again, for simplification, edgings 24' have been deleted. In order to cut the two two-by-fours, edger saw 14*b* is shifted to the position depicted in solid lines in FIG. 5, and lifter arm 32*a* and rollers 34*a* are subsequently moved into the position also depicted in solid lines in FIG. 5. Edger saw 14*c* is positioned also as depicted in solid lines, so that two two-by-four boards 24 are cut and so that lifter arms 32 and 32*a* and rollers 34 and 34*a* support each of the boards. Thus, edgings 24' (not shown) are permitted to drop downwardly due to lack of support as the boards 24 glide up lifter arms 32 and 32*a*.

Position D of FIG. 5 depicts the cutting of a two-by-six board and a two-by-four board from a single lumber slab. In order to perform the cutting operation, edger saw 14*b* is shifted to the position depicted in phantom in FIG. 5, as is edger saw 14*c*. Lifter arm 32*a* and rollers 34*a* are then shifted to the position depicted in phantom, thereby providing support for the two-by-four board, while rollers 34 provide support for the two-by-six. The edgings 24' (not shown) are permitted to drop downwardly by gravity as the boards 24 are conveyed up the incline provided by lifter arms 32 and 32*a*.

Operation of the Depicted Embodiment

The complete operation of the edging picker conveyor 10 will now be described, beginning with the edging operation taking place at edger 12. If a pair of two-by-four boards are to be cut from a lumber slab being fed into edger 12, edger saws 14*a*, 14*b*, and 14*c* will be disposed as depicted in solid lines in FIG. 1. It will be assumed that lifter arms 32 and 32*a* are already disposed in the position depicted in solid lines in FIGS. 1 and 3, ready to receive the two two-by-four boards.

Once boards 24 and edgings 24' are cut by edger saws 14*a*, 14*b*, and 14*c*, the boards and adjacent edgings will be received by first and second drive rolls 18 and 19 and first hold-down roll 26. The weight of first hold-down roll 26 maintains boards 24 and edgings 24' in contact with drive rolls 18 and 19 to prevent slippage. The boards 24 and edgings 24' are then passed to third drive roll 20 and second hold-down roll 28 which operate like drive rolls 18, 19, and first hold-down roll 26 to continue to convey the boards 24 and edgings 24' in a generally horizontal path of travel. Third drive roll 20 and second hold-down roll 28 serve the additional purpose of holding the boards 24 and the edgings 24' in position to prevent any lateral or vertical deflection. The boards 24 and the edgings 24' are then directed across fourth and fifth drive rolls 21 and 22 which are knurled to engage the boards and edgings to minimize the possibility of any lateral deflection. Once the boards 24 begin to glide up rollers 34 and 34*a* on lifter arms 32 and 32*a*, the boards will typically be lifted out of engagement with fourth and fifth drive rolls 21 and 22. However, the edgings 24' are normally maintained in contact with fourth and fifth drive rolls 21 and 22, as depicted in FIG. 3, thereby ensuring that the edgings will be continuously conveyed in a downstream direction.

As shown at position C in FIG. 5, the two two-by-four boards 24 are received by rollers 34 and 34*a* on lifter arms 32 and 32*a*, thereby directing the boards along an upwardly inclined path of travel. No support is provided to the edgings 24', which therefore continue to pass along a substantially horizontal path of travel as depicted in phantom in FIG. 2. As drive rolls 18–22 continue to convey the boards 24 and the edgings 24' in a downstream direction, the boards 24 glide up rollers 34 and 34*a* and are received by first, second, and third outfeed shaft rolls 66, 68, and 70. The path of the edgings 24', on the other hand, becomes progressively inclined in a downward direction as the edgings pass downstream of fifth drive roll 22, since they are not supported in any way. The edgings 24' thus pass below first, second, and third outfeed rolls 66, 68, and 70, thereby positively segregating the boards 24 with respect to the edgings 24'. Eventually, once the trailing edges of the edgings 24' clear second hold-down roll 28 and a third drive roll 20, the edgings begin to drop downwardly into the bin or conveyor means (not shown) disposed below the edging picker conveyor 10. As mentioned above, fourth and fifth drive rolls 21 and 22 continue to convey the edgings 24' in a downstream direction until the trailing edge of the edgings pass these drive rolls. In the event the lumber is stiffer than normal, the edgings 24' may not drop downwardly until the leading edge contacts edging shear 72, which wedges the edgings downwardly until the trailing edge of the edgings clears second hold-down roll 28 and third drive roll 20, at which point the edgings drop downwardly from the edging picker conveyor 10.

When the boards 24 come into contact with first and second outfeed shaft rolls 66 and 68, these shaft rolls begin to take over the drive of the boards. The boards are subsequently passed on to third outfeed roll 70 and to the additional outfeed roll 80 which, in combination with other outfeed rolls (not shown), convey the boards to the next processing station (not shown).

When the trailing edges of the two two-by-four boards 24 and edgings 24' have cleared edger saws 14*a*, 14*b*, and 14*c*, the saws may then receive the next lumber slab without waiting for the two two-by-fours to clear the edging picker conveyor 10. Thus, if the next lumber slab is to be cut into a two-by-six and a two-by-four, edger saws 14*b* and 14*c* may be repositioned. As noted above, in many of the prior art designs such transverse shifting of the edger saws must be delayed until after the previous boards clear the edging picker conveyor. The time delay built into the circuitry, which interconnects the means for transversely shifting the edger saws and corresponding means for the lifter arms, provides sufficient time for the two two-by-four boards 24 to clear ramp lifter arms 32 and 32*a*. Thus, with edger saws 14*b* and 14*c* shifted to the position depicted in phantom in FIG. 1, a two-by-six and a two-by-four board will be cut. Once the circuit time delay has passed, normally no longer than one to one and a half seconds, the two-by-four boards 24 will have had time to clear lifter arms 32 and 32*a*, thus permitting lifter arm 32*a* to be shifted two inches to the position depicted in phantom in FIGS. 1 and 3. This two-inch shift is provided by sending control air to the two-inch section 52*a* to extend that section of control cylinder 52. By the time the leading edge of the two-by-six and two-by-four boards reach lifter arms 32 and 32*a*, lifter arm 32*a* is in position to receive the two-by-four board 24. In the event that a single two-by-six board is to be cut, the two-inch section 52*a* of control cylinder 52 is maintained in its extended position and the three-inch section 52*b* is also extended to shift lifter arm 32*a* a full five inches from the initial position depicted in solid lines in FIGS. 1 and 3.

The operations thus continues with edger saws 14*b* and 14*c* and lifter arm 32*a* being transversely shifted as necessary to saw and handle boards of differing widths.

In the event that only two edger saws are provided (not shown), it may be possible to include only a single lifter arm (not shown). However, even with only two saws it is often desirable to include a second, transversely adjustable lifter arm to handle wider boards such as two-by-twelves. In the event that four or more edger saws are provided, an additional lifter arm is normally included for each additional edger saw.

Of course, it should be understood that various changes and modifications of the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. A lumber edging picker conveyor adapted to receive boards and adjacent edgings from a lumber edger having a plurality of edger saws, wherein the conveyor comprises:

means for driving the boards along a first path of travel, while driving the edgings along a second path of travel, said second path being vertically divergent with respect to said first path;

laterally extending support means for receiving the boards from said driving means and for supporting the boards in said first path of travel; and means for transversely displacing at least a portion of said driving means in response to transverse displacement of at least one of the edger saws;

said transverse displacement means including time delay means for delaying the transverse displacement of said driving means in response to transverse displacement of at least one of the edger saws.

2. A lumber edging picker conveyor comprising:

lumber drive means for receiving boards and adjacent edgings from a lumber edger and for driving the boards and the edgings along a predetermined path; and inclined ramp means for conveying only the boards along an upwardly inclined path while the boards and the edgings are being driven by said lumber drive means, so that the boards will be progressively displaced vertically with respect to the edgings;

the conveyor being adapted to receive lumber from an edger having a first, a second, and a third saw, the second and third saws being transversely displaceable to saw boards of various widths;

said inclined ramp means comprising a first upwardly inclined ramp member disposed to receive boards cut between the first and second saws, and a second upwardly inclined ramp member disposed to receive boards cut between the second and third saws, said second ramp member including means for transverse displacement thereof to accommodate for transverse displacement of the second and third saws, said first and second ramp members being no wider than the cut boards they are adapted to receive.

3. The conveyor of claim 2 wherein each of said ramp members includes a plurality of radially aligned, freely rotatable rollers for receiving boards and permitting them to glide upwardly toward said support means.

4. The conveyor of claim 3 wherein said means for transversely displacing said second ramp member include time delay means for delaying the transverse displacement of said second ramp member after displacement of the second and third saws.

5. An edging picker conveyor for separating edgings from edged boards comprising:

first conveyor means downstream of the saws for receiving and conveying the edgings and the edged boards endwise;

second conveyor means downstream of and in line with said first conveyor means but spaced therefrom to define a gap therebetween, said second conveyor means being disposed at a different level than said first conveyor means;

said first conveyor means being driven and operable to convey the edged boards and edgings endwise downstream into and beyond said gap; and ramp means bridging said gap so that said first conveyor means can convey edged boards endwise over said ramp means and onto said second conveyor means, said ramp means including separate ramp elements defining the lateral limits of said ramp means, at least one of said separate ramp elements being selectively movable transversely to determine which of the cut edgings and boards will be conveyed by said first conveyor means onto said ramp means.

6. An apparatus according to claim 5 wherein said second conveyor means is positioned at a level above said first conveyor means and said ramp means is upwardly inclined from said first conveyor means to said second conveyor means.

7. An apparatus according to claim 5 wherein said first and second conveyor means are driven and said ramp means is undriven.

8. An apparatus according to claim 6 wherein the length of said ramp means is substantially shorter than the length of said first conveyor means as measured from said saws to the lower end of said ramp means.

9. An apparatus according to claim 5 wherein said first conveyor means includes lumber hold-down means for maintaining a desired longitudinal alignment of the boards after they leave said saws.

10. An apparatus according to claim 9 wherein said first conveyor means includes driven conveyor rolls and said hold-down means includes a pair of longitudinally spaced-apart hold-down rolls.

11. An apparatus according to claim 10 wherein the downstream one of said pair of hold-down rolls is positioned along said first conveyor means such that a board traveling downstream of said saws has its leading end positioned on said second conveyor means as its trailing end leaves said downstream hold-down roll, said second conveyor means being a driven conveyor means.

12. An apparatus according to claim 5 wherein a first of said saws is laterally movable, said one laterally movable ramp element being movable laterally in response to lateral movement of said first saw so as to always maintain said movable ramp element in a longitudinally-aligned position between said first saw and a second of said saws.

13. An apparatus according to claim 12 including means for moving said laterally-movable ramp element after lateral movement of said first saw to enable said first saw to position itself for edging a second board while said laterally-movable ramp element is positioned for separating edgings from a first board.

14. An edging picker conveyor for separating at least one edging from an adjacent board comprising:

first driven conveyor means extending downstream of a saw means for receiving and conveying endwise downstream said edging and board;

second driven conveyor means downstream of and in line with said first conveyor means but spaced therefrom to define a gap therebetween, said second conveyor means being disposed at a level above said first conveyor means;

said first conveyor means including hold-down means operable to maintain said edged board and edging endwise in alignment with said second conveyor means as they are conveyed downstream by said first conveyor means into and beyond said gap; and inclined ramp means bridging said gap and inclined in a direction from said first conveyor means to said second conveyor means, said ramp means being longitudinally aligned with said edged board and having an effective width less than said first conveyor means, such that said first conveyor means drives said edged board up said ramp means and onto said second conveyor means, whereas said first conveyor means drives said edging along a transversely straight path parallel to and laterally offset from said ramp means and at level below said second conveyor means.

15. An apparatus according to claim 14 wherein said saw means includes a laterally-movable first saw and an adjacent second saw, said ramp means including separate ramp elements defining the effective width of said ramp means, one of said ramp elements being laterally adjustable in delayed response to lateral movement of said first saw so as to always maintain said adjustable ramp element in a longitudinally-aligned position between said first and second saws.

16. An apparatus according to claim 15 wherein said saw means further includes a fixed third saw on a side of said second saw opposite said first saw, said second saw being laterally movable.

17. An apparatus according to claim 15 wherein said conveyor includes aperture means at the end of said first conveyor means through which said edging is permitted to drop, by gravity, with respect to said board.

18. An apparatus according to claim 16 wherein said ramp elements each comprise longitudinally-extending guides with a plurality of rollers secured thereto.

19. A lumber sorter system for separating at least two adjacent, elongate pieces of lumber cut by a saw means including at least one sawing element, said system comprising:

first driven conveyor means extending downstream from said sawing element for receiving and conveying said pieces endwise downstream;

second driven conveyor means downstream of and in line with said first conveyor means but spaced therefrom to define a gap therebetween, said second conveyor means being disposed at a level above said first conveyor means;

said first conveyor means including hold-down means operable to maintain longitudinal alignment of said pieces with said second conveyor means as said pieces are conveyed downstream from said sawing element and into and beyond said gap; and inclined ramp means briding said gap and inclined in a direction from said first conveyor means to said second conveyor means so that said first conveyor means can convey pieces endwise over said ramp means and onto said second conveyor means, the lateral limits of said ramp means being less than the lateral limits of said first conveyor means, said ramp means being aligned longitudinally with said first conveyor means but being offset laterally on one side of said sawing element such that a first of said pieces is conveyed by said first conveyor means up said ramp means and onto said second conveyor means, whereas a second of said pieces is driven by said first conveyor means downstream along a path transversely parallel to and offset laterally from said ramp means and at a level below said second conveyor means.

* * * * *

UNITED STATES PATENT AND TRADEMARK OFFICE

CERTIFICATE OF CORRECTION

PATENT NO. : 4,430,915

DATED : February 14, 1984

INVENTOR(S) : Jeffrey D. Rutherford

It is certified that error appears in the above-identified patent and that said Letters Patent are hereby corrected as shown below:

Column 2, line 7, "patient" should be --patent--.

Column 3, line 44, "displayed" should be --displaced--.

Column 4, line 13, "differential" should be --different--.

Column 6, line 41, "and" should be --of--.

Column 6, line 54, "second" should be --send--.

Signed and Sealed this

Twenty-ninth Day of May 1984

[SEAL]

*Attest:*

GERALD J. MOSSINGHOFF

*Attesting Officer*

*Commissioner of Patents and Trademarks*